US010927845B2

(12) United States Patent
Lin et al.

(10) Patent No.: US 10,927,845 B2
(45) Date of Patent: Feb. 23, 2021

(54) SEAL ASSEMBLY AND METHOD FOR REDUCING AIRCRAFT ENGINE OIL LEAKAGE

(71) Applicant: The Boeing Company, Chicago, IL (US)

(72) Inventors: Chao-Hsin Lin, Redmond, WA (US); Raymond H. Horstman, Snohomish, WA (US); George Bates, III, Bothell, WA (US)

(73) Assignee: The Boeing Company, Chicago, IL (US)

( * ) Notice: Subject to any disclaimer, the term of this patent is extended or adjusted under 35 U.S.C. 154(b) by 655 days.

(21) Appl. No.: 15/603,762

(22) Filed: May 24, 2017

(65) Prior Publication Data

US 2018/0340546 A1 Nov. 29, 2018

(51) Int. Cl.
*F04D 29/08* (2006.01)
*F01D 25/18* (2006.01)
(Continued)

(52) U.S. Cl.
CPC ..... *F04D 29/083* (2013.01); *F01D 25/183* (2013.01); *F04D 27/009* (2013.01);
(Continued)

(58) Field of Classification Search
CPC .... F04D 25/183; F04D 27/009; F04D 29/056; F04D 29/063; F04D 59/083; F04D 29/522; F04D 2260/609; F04D 29/083; F04D 29/102; F04D 29/122; F16J 15/44; F16J 15/443; F16J 15/447; F16J 15/4472; F16J 15/4474; F16J 5/004; F16J 15/004;
(Continued)

(56) References Cited

U.S. PATENT DOCUMENTS 3,071,384 A * 1/1963 Friberg ..... F01D 11/04 277/430
5,161,364 A 11/1992 Bruun et al.
(Continued)

FOREIGN PATENT DOCUMENTS

EP 1255024 A2 11/2002
EP 1724445 A2 11/2006
(Continued)

OTHER PUBLICATIONS

Contamination of aircraft cabin by bleed air—a review of the evidence, Civil Avaiation Safety Authority, Australia, 2009.
(Continued)

*Primary Examiner* — Philip E Stimpert
(74) *Attorney, Agent, or Firm* — Felix L. Fischer

(57) ABSTRACT

A seal assembly for a gas turbine engine employs a first seal forming an oil chamber around a bearing. The first seal is configured to maintain the oil chamber at a first pressure. A second seal forms a ventilating cavity around the oil chamber. The second seal is configured to maintain the ventilating cavity at a second pressure, the second pressure being less than the first pressure and less than an ambient pressure of a primary flow path in the engine. A pressure reducing device is coupled to the ventilating cavity. The pressure reducing device is configured to maintain the second pressure.

20 Claims, 5 Drawing Sheets

(51) Int. Cl.

| | |
|---|---|
| ***F04D 27/00*** | (2006.01) |
| ***F04D 29/056*** | (2006.01) |
| ***F04D 29/063*** | (2006.01) |
| ***F04D 29/52*** | (2006.01) |

(52) U.S. Cl.
CPC ..... *F04D 29/056* (2013.01); *F04D 29/063* (2013.01); *F04D 29/522* (2013.01); *F05D 2260/609* (2013.01)

(58) Field of Classification Search
CPC ..... F05D 2260/609; F05D 2240/54; F05D 2260/98; F01D 25/18; F01D 25/183; F01D 25/16; F01D 25/20; F16C 33/6622; F16C 33/6685
USPC ..... 384/322, 400, 462, 473, 398
See application file for complete search history.

(56) References Cited

U.S. PATENT DOCUMENTS

| | | | | |
|---|---|---|---|---|
| 5,540,447 | A * | 7/1996 | Shultz | F01D 25/04 277/303 |
| 5,611,661 | A * | 3/1997 | Jenkinson | F01D 25/183 184/6.11 |
| 6,305,156 | B1 | 10/2001 | Lui | |
| 8,967,528 | B2 | 3/2015 | Mackin et al. | |
| 2015/0323186 | A1* | 11/2015 | Xu | F02O 7/224 60/782 |
| 2017/0184472 | A1* | 6/2017 | Fechner | G01N 33/0004 |

FOREIGN PATENT DOCUMENTS

| | | | |
|---|---|---|---|
| EP | 2157289 | A2 | 2/2010 |
| WO | 2016030845 | A1 | 3/2016 |

OTHER PUBLICATIONS

Bagshaw, M.; Health effects of contamination in aircraft cabin air, Summary Report v2.7, ASMA, 2014.

* cited by examiner

SEAL ASSEMBLY AND METHOD FOR REDUCING AIRCRAFT ENGINE OIL LEAKAGE

BACKGROUND INFORMATION

Field

Embodiments of the disclosure relate generally to lubrication of bearings in aircraft engines and more particularly to pressure control and routing of leaking oil to an overboard location out of the engine compressor flow.

Background

Gas turbine engines include pressurized oil bearings that support the rotating fan, compressor and turbine shafts. Specifically, the bearings support the rotating segments within the stationary segments. The gas turbine engines also include various oil seals surrounding the bearings to prevent oil leakage. However, in operation the seals may leak as the engine wears or the seals may fail. Since the bearings and oil seals are pressurized, there is a potential to aerosolize the oil that is not contained by the leaking seals, into the compressor air stream. As the compressor air stream may be used for various purposes on the aircraft, it is desirable to prevent aerosolized oil from being introduced into the aircraft in the event an oil seal leak occurs.

SUMMARY

As disclosed herein a seal assembly for a gas turbine engine employs a first seal forming an oil chamber around a bearing. The first seal is configured to maintain the oil chamber at a first pressure. A second seal forms a ventilating cavity around the oil chamber. The second seal is configured to maintain the ventilating cavity at a second pressure, the second pressure being less than the first pressure and less than an ambient pressure. A pressure reducing device is coupled to the ventilating cavity. The pressure reducing device is configured to maintain the second pressure.

The embodiments disclosed provide a method for reducing oil leakage into bleed air wherein an oil chamber is sealed with a first seal to maintain a first pressure. A ventilating cavity surrounding the oil chamber is sealed with a second seal configured to maintain a second pressure. A suction conduit connected between the ventilating cavity and a pressure reducing device maintains the second pressure less than the first pressure and less than an ambient pressure of the primary air flow path. Oil leaking through the first seal is drawn into the ventilating cavity and air leaking through the second seal is also drawn into the ventilating cavity. The ventilating cavity is exhausted through the pressure reducing device to an external outlet.

BRIEF DESCRIPTION OF THE DRAWINGS

The features, functions, and advantages that have been discussed can be achieved independently in various embodiments of the present disclosure or may be combined in yet other embodiments, further details of which can be seen with reference to the following description and drawings.

DETAILED DESCRIPTION

The embodiments and methods described herein provide a dual labyrinth seal assembly for a gas turbine engine. The first seal defines an inner cavity that surrounds a bearing such as the forward compressor bearing. A second seal defines an outer cavity that surrounds the inner cavity. In operation, any oil leakage that occurs as a result of leakage around the first labyrinth seal is transmitted into the cavity defined by the second labyrinth seal. A vacuum system creates a vacuum within the second cavity such that any oil that is within the second cavity is extracted and then sent overboard via the fan airstream. The vacuum system includes connection to the outer cavity in a first embodiment with an evacuation tube or channel that is formed integrally with or integrated into static structural elements of the engine such as the front compressor frame for the exemplary compressor bearing. The vacuum system also includes low pressure sink such as a scupper connected to the evacuation tube such that any oil located in the second cavity is drawn thru the tube, through the scupper, and into the fan airstream. More specifically, the fan airstream is used to create the vacuum within the second cavity. Alternatively, a pump may be employed as the low pressure sink connected to the evacuation tube and then ported overboard.

Figure 1:
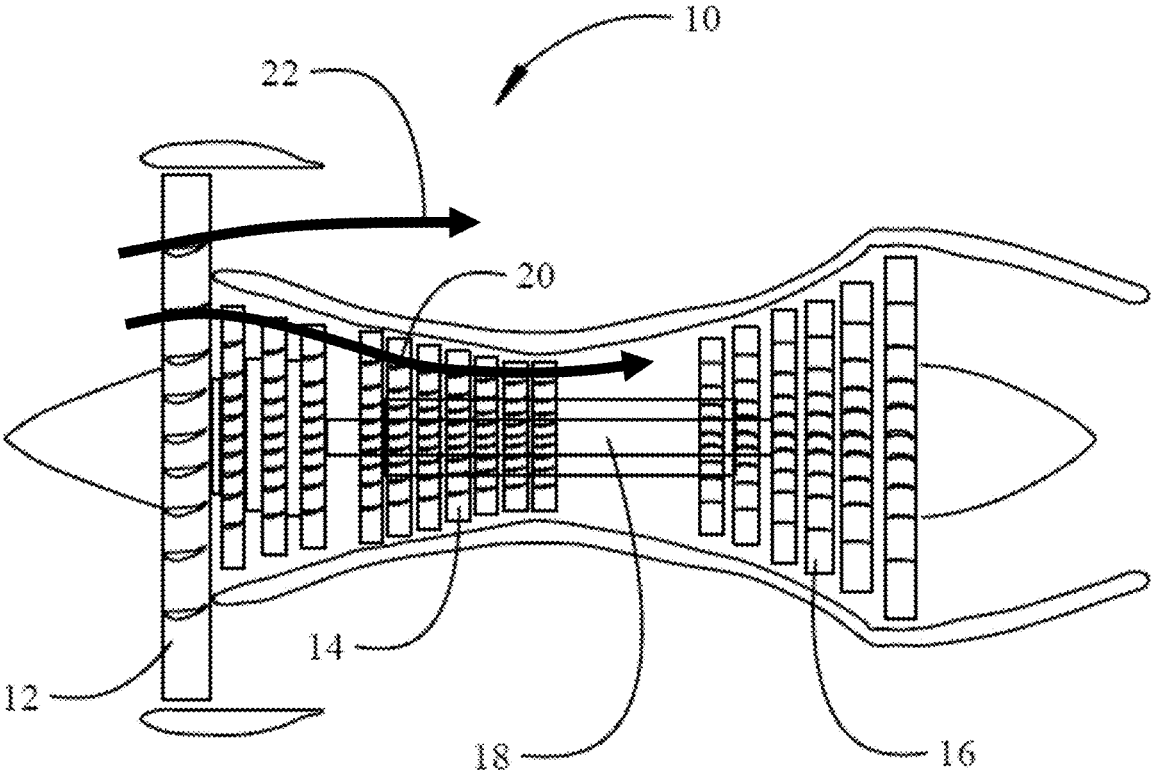
FIG. 1 is schematic section view of an aircraft engine.

As seen in FIG. 1, a modern aircraft gas turbine engine 10 employs a rotating fan 12, compressor 14 and turbine 16. These rotating components are supported directly on bearings engaged by stationary structure in the engine or are connected to one or more shafts 18 which are in turn supported by bearings. The engine 10 has a primary flow path, represented by arrow 20, through the fan 12, compressor 14 and turbine 16 and a secondary flow path (fan bypass flow), represented by arrow 22. The primary flow path includes bleed air systems which draw air from the compressor to provide air for various aircraft functions.

Figure 2:
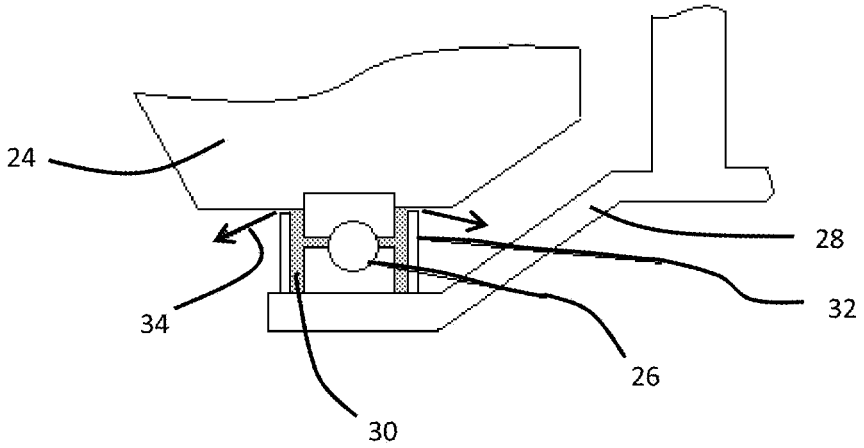
FIG. 2 Prior Art
FIG. 2 is a schematic section view of a prior art rotor bearing.

FIG. 2 shows an exemplary rotating rotor assembly 24 which is supported by a bearing 26 on a stationary structural element 28 in the engine. In the prior art, the bearing 26 incorporated an oil chamber 30 defined by blade seals 32 surrounding the bearing. Oil provided to the chamber 30 is pressurized to assure adequate lubrication of the bearing 26. The pressurized oil was subject to leakage around the blade seals 32 as represented by arrows 34.

Figure 3:
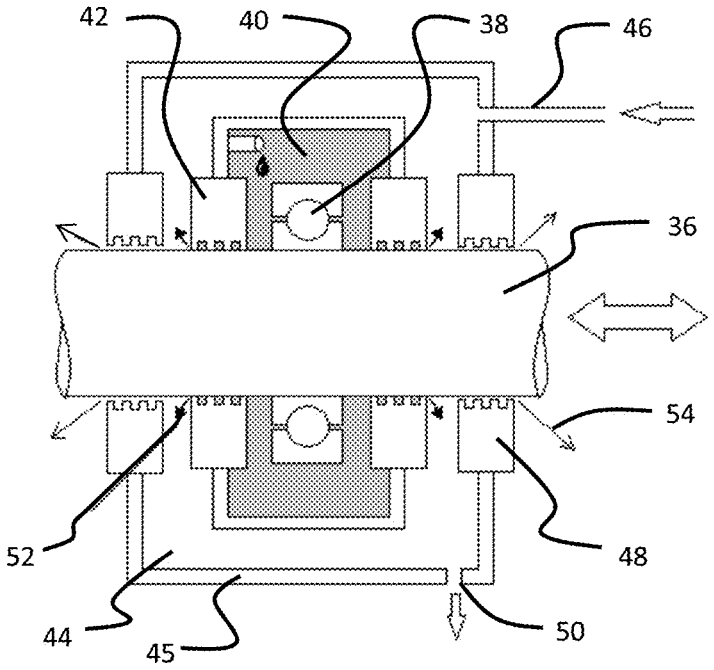
FIG. 3 Prior Art
FIG. 3 is a schematic section view of a prior art shaft bearing.

Similarly, FIG. 3 shows an exemplary shaft 36 supported by a bearing 38. The bearing is surrounded by an oil chamber 40. As in the rotor assembly bearing example, the oil chamber 40 is pressurized and incorporates labyrinth seals 42 to reduce oil leakage from the chamber along the shaft 36. In the prior art, a cavity 44 is formed by a shroud 45 that surrounds the oil chamber 40 and receives pressurizing air through an inlet 46. The shroud 45 incorporates second labyrinth seals 48 engaging the shaft 36. Pressurized air in the shroud reduces leakage of oil from the chamber 40 through the labyrinth seals 42 and was primarily exhausted through an outlet 50 scavenging at least a portion of oil escaping into the shroud. However, oil escaping from the chamber 40 into the shroud as represented by arrows 52 was potentially carried by pressurized air in the shroud through the second labyrinth seals 48 into the airflow as represented by arrows 54. For bearings as shown in either FIG. 2 or FIG. 3 present in the primary flow path 20 of the engine, aerosolized oil could potentially be blended into the bleed air system and into an interior of the aircraft.

Figure 4A:
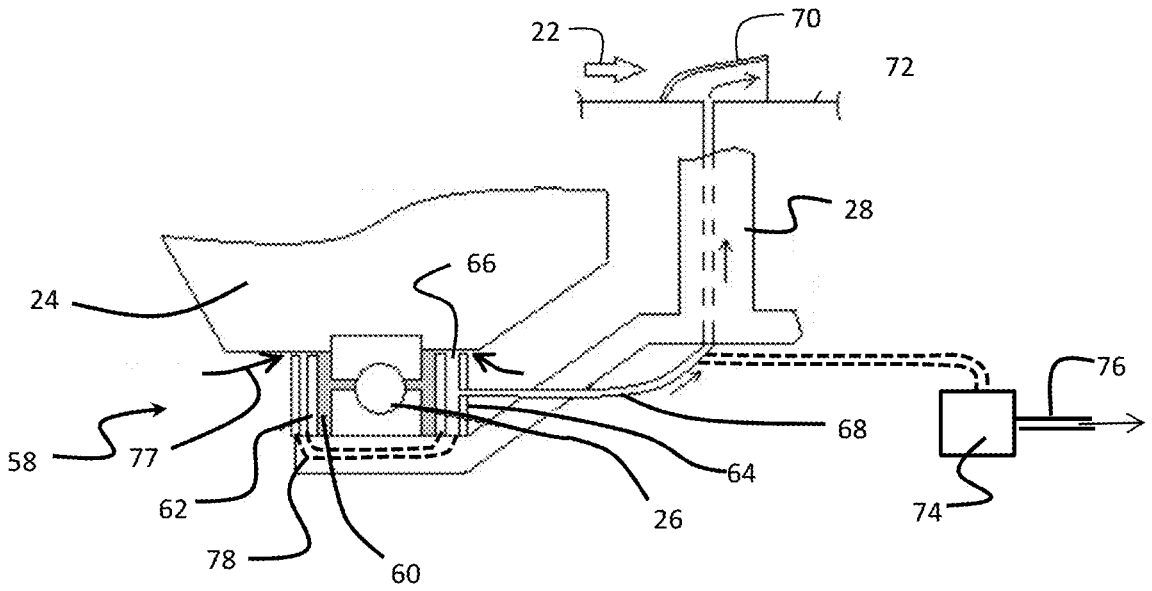
FIG. 4A is a schematic section view of a first embodiment for a rotor bearing.

An embodiment for a first exemplary ventilated bearing seal assembly 58 is shown in FIG. 4A. As in FIG. 2, rotating rotor assembly 24 is supported by a bearing 26 on a stationary structural element 28 in the engine which may be, for example, a compressor front frame or a compressor rear frame. The bearing 26 incorporates a cavity providing an oil chamber 60 defined by a first pair of blade seals 62 surrounding the bearing. Oil provided to the chamber 60 is pressurized by an oil pump (not shown) to assure adequate lubrication of the bearing 26 and first blade seals 62 are configured to maintain a desired first pressure of the oil in the chamber. A second pair of blade seals 64, located outboard of the first pair of blade seals 62, surround the first pair of blade seals with a ventilating cavity 66 on each side of the bearing. A suction conduit 68 connects the ventilating cavity 66 to a pressure reducing device, which for the exemplary embodiment is a scupper 70 on an aerodynamic surface 72 exposed to the fan bypass flow 22, to create a negative pressure differential both between the oil chamber and the ventilating cavity and the external ambient pressure in the primary air flow path and the ventilating cavity. The second blade seals 64 are configured to maintain a second pressure within the ventilating cavities 66 to produce the negative pressure differential. In alternative embodiments, the scupper 70 may be located on an external surface of an engine nacelle. Alternatively, a vacuum pump 74 having an overboard vent 76 may be connected to the suction conduit 68 as shown in phantom in FIG. 4A. Venting of the aerosolized oil vapor or mist overboard either directly or into the fan flow prevents contamination of the air in the primary flow path. For any leakage of the second blade seals 64, air flow surrounding the bearing at the ambient pressure in the primary air flow path is drawn into the ventilating cavity 66 as indicated by arrows 77 thereby preventing any oil vapor or mist from migrating into the primary air stream. The ventilating cavity 66 on each sides of the bearing may be joined by a connecting channel 78 integral to the stationary structure or the suction conduit 68 may be bifurcated to connect both sides of the ventilating cavity to the pressure reducing device.

Figure 4B:
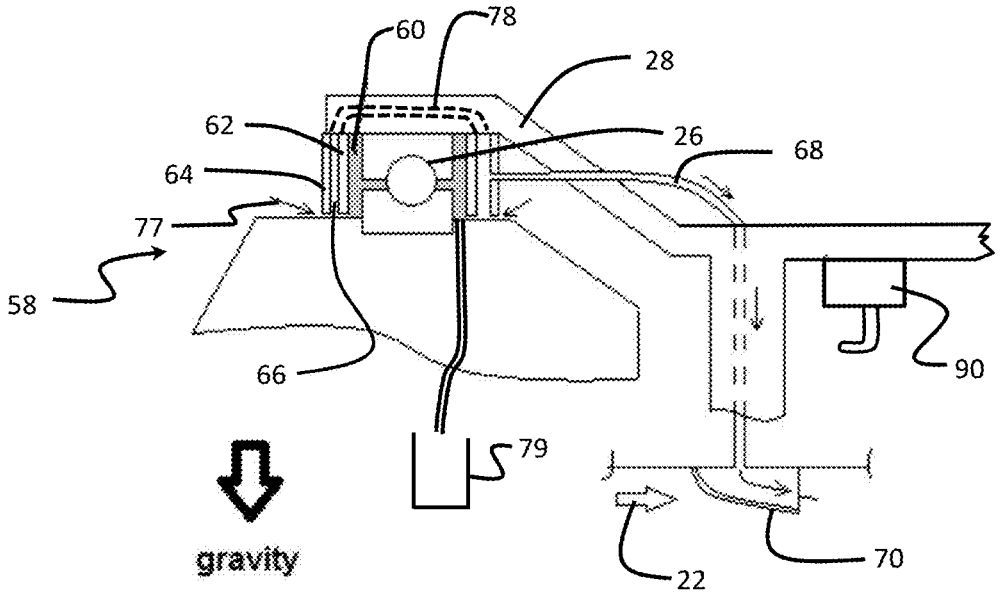
FIG. 4B is a schematic section view of a second embodiment for a rotor bearing.

As shown in FIG. 4B, the suction conduit 68 can employ gravity in addition to the pressure reduction to act as a drain tube for any oil condensate in the ventilating cavity 66 or suction conduit if the scupper 70 is located below the bearing. Both of the bearings in FIGS. 4A and 4B provide oil return by elevated pressure in the oil chamber to a sump 79.

Figure 5:
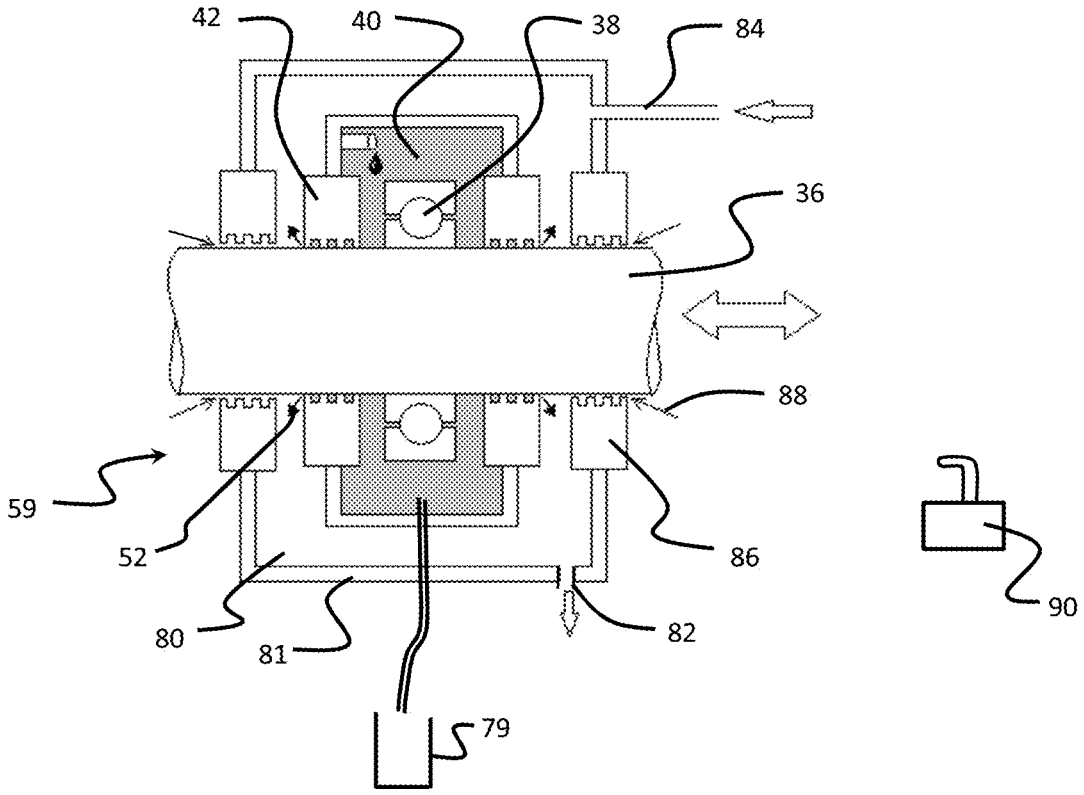
FIG. 5 is a schematic section view of an exemplary embodiment for a shaft bearing; and, FIG. 6 is a flow chart depicting a method for use of a bearing system employing the disclosed embodiments in an aircraft engine.

FIG. 5 demonstrates an embodiment of another seal assembly 59 for use with a shaft bearing 38. As in the bearing disclosed in FIG. 3, an oil chamber 40 provides pressurized oil to the bearing 38. Labyrinth seals 42 are configured to maintain a first pressure to reduce oil leakage from the chamber along the shaft 36. A cavity 80 is formed by a shroud 81 that surrounds the oil chamber 40 to act as a ventilating cavity and is connected through an outlet port with a suction conduit 82 to the pressure reducing device such as the scupper 70 (shown in FIG. 4B) or vacuum pump 74 (shown in FIG. 4A) described for the prior embodiment. An inlet port 84 provides make-up air for air drawn from the shroud by the pressure reducing device. As with the cavity 44 in FIG. 3, the cavity 80 the shroud 81 incorporates second labyrinth seals 86 engaging the shaft 36. Reduced pressure in the cavity 80 constrains any leakage of oil from the chamber 40 through the labyrinth seals 42 and the reduced pressure additional creates an inflow of external air into the shroud through leakage of second labyrinth seals 86 as represented by arrows 88. Second labyrinth seals 86 are configured to maintain a desired second pressure to achieve the reduce pressure in the cavity 80. Oil escaping from the chamber 40 into the shrouded cavity 80 as represented by arrows 52 is contained within the shroud or drawn to the scupper or pump acting as the pressure reducing means to exhaust overboard. As previously described with respect to FIG. 4B, gravity in addition to the pressure reduction may act to drain any oil condensate in the cavity 80 if the scupper 70 is located below the bearing and the cavity 80. As described for the prior embodiments, oil from the chamber 40 is retuned to a sump 79 to be returned to the oil pump (not shown). The length 90 of the shroud 81 surrounding cavity 80 should be sufficient to span the relative positions of oily portions of the shaft surface accommodating shaft positing shifts with load and temperature.

For either the embodiments disclosed in FIGS. 4A and 4B or the embodiment of FIG. 5, an oil leak detection sensor 90 may be employed in the airstream downstream of the bearing to detect oil leakage.

For exemplary operation of the embodiments herein an engine oil pump providing oil to the bearings discharges oil at about 40 psig when at the slow rotating speeds of idle power and around 60 psig when at high power and rotational speeds. This pressure is reduced by the friction of oil flowing through the filters, heat exchangers and oil lubrication flow tubes before reaching the bearings. The oil is introduced into the bearing at between approximately 5 to 10 psi in order to have enough momentum when discharged from the end of the lubrication tube that the oil penetrates into all the remote areas of the bearing.

The oil chamber (60, 40) of the exemplary bearings (26, 38) in the disclosed embodiments operates slightly above atmospheric pressure, nominally less than 1 psig. This low pressure does several things. The pressure assisted by gravity drains the oil from the bearing into a sump (79) where the oil is sent through the oil pump again to be reused in the bearings. The low pressure minimizes sealing capacity the second blade seals (64, 86) have must have to prevent oil and vapor from escaping the ventilating cavity 66. It is preferable to have the oil encouraged into the sump with a low pressure and gravity rather than be blown into the core cavity of the engine and vented to the atmosphere.

In the prior art, the blade seals and labyrinth seals all operate at less than 1 psig above the atmospheric pressure to minimize the pressure on the seals. Any oil/oil vapor that escapes the seals of the bearing is allowed into the inner volume of the engine rotating parts which can get into the compressor airstream. It is when this oil product gets into the compressor air stream that the potential for contamination of the bleed air supplied to the aircraft can occur.

The present embodiments employ the pressure reducing device to provide a slight vacuum (negative) pressure relative to atmospheric pressure. The vacuum required will depend on the flow capacity of the suction conduit (68, 82); for example a ¼" diameter, 7 ft. long conduit with a 3 quart/hr. oil leak at 67 F (fan exit temperature in cruise) would require at least −0.03 psig in exemplary embodiments in the ventilating cavity 66 or cavity 80. In the exemplary embodiments this accomplished by venting the volume between the seals to the fan stream of the engine via tubes and a venturi to create a pressure reduction due to the Bernoulli effect (as is known in the art) in the scupper 70. In cruise conditions of the aircraft, the scupper suction pressure is may be as low as −0.53 psig. Any time the fan airflow is flowing through the fan duct during engine operation the flow over an aerodynamic hood covering the bearing seal vent tube applies a slightly negative pressure below atmospheric, at least −0.2 psig, on the suction conduit 68. This negative pressure pulls any oil or oil vapor that escapes the bearing through the first blade seal 62 into the ventilating volume 66 between the first blade seal and second blade seal 64. This negative pressure places the oil/oil vapor into the fan stream of the engine to be discharged into the atmosphere outside of the engine and not into the engine airflow stream. The embodiments described are operable with the first pressure of the oil chamber (60, 40) at any pressure over the ambient pressure in the primary flow path of the engine and the second pressure in the ventilating cavity 66 or cavity 80 at less than the ambient pressure in the primary flow path thereby creating the desired negative pressure differentials to prevent oil vapor from entering the primary flow path.

Figure 6:
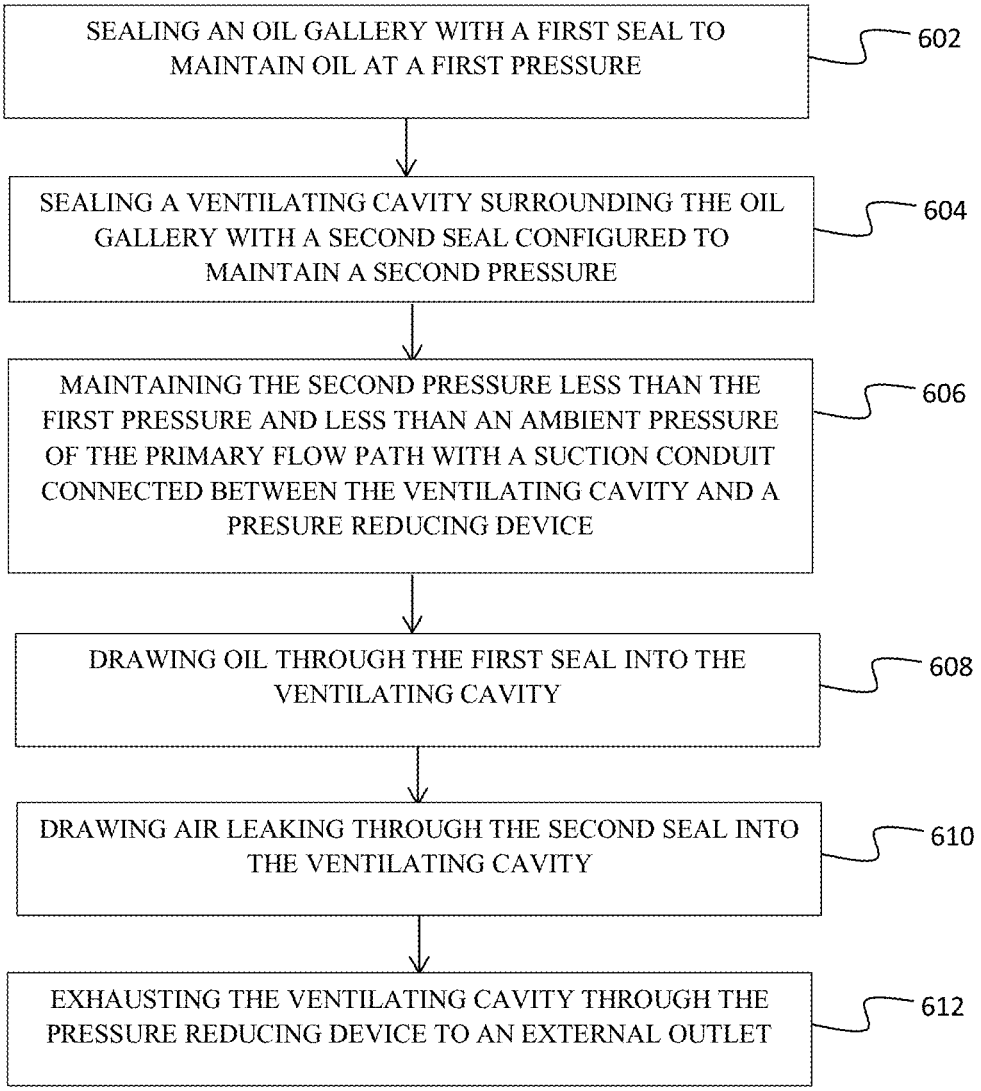

As shown in FIG. 6, the present embodiments provide a method for eliminating or reducing the potential for aerosolized oil from entering the primary air flow path in a gas turbine engine. An oil chamber is sealed with a first seal, step 602, to maintain a first pressure. A ventilating cavity surrounding the oil chamber is sealed with a second seal, step 604, configured to maintain a second pressure. A suction conduit connected between the ventilating cavity and a pressure reducing device maintains the second pressure less than the first pressure and less than an ambient pressure of the primary air flow path, step 606. Oil leaking through the first seal is drawn into the ventilating cavity, step 608, and air leaking through the second seal is also drawn into the ventilating cavity, step 610. The ventilating cavity is exhausted through the pressure reducing device to an external outlet, step 612.

Having now described various embodiments of the disclosure in detail as required by the patent statutes, those skilled in the art will recognize modifications and substitutions to the specific embodiments disclosed herein. Such modifications are within the scope and intent of the present disclosure as defined in the following claims.

What is claimed is:

1. A seal assembly for a gas turbine engine, the seal assembly comprising:

an oil chamber around a bearing, said oil chamber being partially defined by a first seal pair, the oil chamber receiving pressurized oil for lubrication of the bearing, the first seal pair configured to maintain the oil chamber at a first pressure;

a ventilating cavity around the oil chamber, said ventilating cavity being partially defined by the first seal pair and a second seal pair, the second seal pair configured to maintain the ventilating cavity at a second pressure, the second pressure being less than the first pressure and less than an ambient pressure in a primary flow path; and a pressure reducing device in direct fluid communication with the ventilating cavity, the pressure reducing device configured to maintain the second pressure.

2. The seal assembly of claim 1, wherein the first pressure is greater than the ambient pressure in the primary flow path and the second pressure is less than the ambient pressure in the primary flow path.

3. The seal assembly of claim 1, wherein the first and second seal pairs comprise a first pair of blade seals disposed on opposite sides of the bearing and a second pair of blade seals disposed outboard of the first pair of blade seals, the first pair and second pair of blade seals being disposed within the primary flow path.

4. The seal assembly of claim 1, wherein the first and second seal pairs comprise a first labyrinth seal and a second a labyrinth seal, the first and second labyrinth seals being disposed within the primary flow path.

5. The seal assembly of claim 1, wherein the pressure reducing device comprises a suction conduit in flow communication with the ventilating cavity and a scupper disposed in a fan airstream of the gas turbine engine, the scupper configured to create a Bernoulli effect in the suction conduit to generate the second pressure.

6. The seal assembly of claim 5, wherein the suction conduit is disposed within a compressor front frame.

7. The seal assembly of claim 1, wherein the pressure reducing device is configured to transfer oil contained within the second cavity into a fan airstream.

8. The seal assembly of claim 3 wherein the ventilating cavity is interconnected by a connecting channel integral to a stationary structure supporting the bearing.

9. A seal assembly for a gas turbine engine, the seal assembly comprising:

an oil chamber around a bearing, the oil chamber being partially defined by a first seal pair, the oil chamber receiving pressurized oil for lubrication of the bearing, the first seal pair configured to maintain the oil chamber at a first pressure;

a ventilating cavity around the oil chamber, the ventilating cavity being partially defined by the first seal pair and a second seal pair, the second seal pair configured to maintain the ventilating cavity at a second pressure, the second pressure being less than the first pressure and less than an ambient pressure in a primary flow path;

a suction conduit disposed within a compressor front frame and in direct fluid communication with the ventilating cavity, connected to a pressure reducing device configured to maintain the second pressure; and a leak detection sensor configured to identify oil being discharged into the fan airstream.

10. A gas turbine engine comprising:

a seal assembly having an oil chamber around a bearing, the oil chamber being partially defined by a first seal pair, the oil chamber receiving pressurized oil for lubrication of the bearing, the first seal pair configured to maintain the oil chamber at a first pressure; and a ventilating cavity around the oil chamber, the ventilating cavity being partially defined by the first seal pair and a second seal pair, the second seal pair configured to maintain the ventilating cavity at a second pressure, the second pressure being less than the first pressure and less than an ambient pressure of a primary flow path; and a pressure reducing device in direct fluid communication with the ventilating cavity, the pressure reducing device configured to maintain the second pressure.

11. The gas turbine engine of claim 10, further comprising a compressor front frame, at least a portion of the seal assembly disposed within the compressor front frame.

12. The gas turbine engine of claim 10, further comprising a compressor rear frame, at least a portion of the seal assembly disposed within the compressor rear frame.

13. The gas turbine engine of claim 10 wherein the pressure reducing device comprises a suction conduit in flow communication with the ventilating cavity and a scupper disposed in a fan airstream of the gas turbine engine, the scupper configured to create a Bernoulli effect in the suction conduit to generate the second pressure.

14. The gas turbine engine of claim 13, wherein the suction conduit is disposed within a compressor front frame.

15. The gas turbine engine of claim 13, wherein the suction conduit is disposed within a compressor rear frame.

16. A method to reduce engine oil leakage into bleed air comprising:

sealing an oil chamber receiving pressurized oil for lubrication of a bearing in the oil chamber with a first seal pair to maintain a first pressure;

sealing a ventilating cavity surrounding the oil chamber with the first seal pair and a second seal pair to maintain a second pressure;

maintaining the second pressure less than the first pressure and less than an ambient pressure of a primary flow path in a gas turbine engine with a suction conduit between the ventilating cavity and a pressure reducing device;

drawing oil leaking through the first seal into the ventilating cavity;

drawings air leaking through the second seal into the ventilating cavity;

exhausting the ventilating cavity through the suction conduit and the pressure reducing device to an external outlet.

17. The method of claim 16, wherein the first and second seal pairs comprise a first pair of blade seals disposed on opposite sides of the bearing and a second pair of blade seals disposed outboard of the first pair of blade seals, the first pair and second pair of blade seals being disposed within the primary flow path.

18. The method of claim 16, wherein the first and second seal pairs comprise labyrinth seals, the first and second labyrinth seals being disposed within the primary flow path.

19. The method of claim 16, wherein the pressure reducing device comprises a scupper disposed in a fan airstream of the gas turbine engine, the scupper configured such that the step of maintaining the second pressure comprises creating a Bernoulli effect in the suction conduit.

20. The method of claim 16, wherein the suction conduit is disposed within a compressor front frame.

* * * * *